US006648317B2

(12) United States Patent
Takahashi et al.

(10) Patent No.: US 6,648,317 B2
(45) Date of Patent: Nov. 18, 2003

(54) CLAMP APPARATUS

(75) Inventors: Kazuyoshi Takahashi, Koto-ku (JP); Atsushi Tamai, Kitasoma-gun (JP)

(73) Assignee: SMC Kabushiki Kaisha, Tokyo (JP)

( * ) Notice: Subject to any disclaimer, the term of this patent is extended or adjusted under 35 U.S.C. 154(b) by 67 days.

(21) Appl. No.: 09/991,935

(22) Filed: Nov. 26, 2001

(65) Prior Publication Data

US 2002/0063371 A1 May 30, 2002

(30) Foreign Application Priority Data

Nov. 27, 2000 (JP) ..... 2000-359599

(51) Int. Cl.[7] ..... B23Q 3/03
(52) U.S. Cl. ..... 269/32; 269/228; 269/24
(58) Field of Search ..... 269/32, 228, 24, 269/27, 239, 91, 93, 94; 92/23–25

(56) References Cited

U.S. PATENT DOCUMENTS 4,458,889 A 7/1984 McPherson et al.
5,676,357 A * 10/1997 Horn ..... 269/32
5,704,600 A * 1/1998 Robinson ..... 269/32
5,884,903 A * 3/1999 Sawdon ..... 269/32
6,435,494 B2 * 8/2002 Takahashi et al. ..... 269/32

FOREIGN PATENT DOCUMENTS

DE 41 11 430 A1 10/1991
DE 299 20 639 U1 5/2000

* cited by examiner

*Primary Examiner*—Lee D. Wilson
(74) *Attorney, Agent, or Firm*—Paul A. Guss

(57) ABSTRACT

A clamp with a rotatable arm for clamping a workpiece has an impact-reducing mechanism, thereby reducing an impact exerted when the arm comes into contact with the workpiece. The impact-reducing mechanism has first and second plates. A support lever is provided between the first and second plates, and sides of the support lever are engaged with plate springs of the first and second plates, respectively.

17 Claims, 17 Drawing Sheets

CLAMP APPARATUS

BACKGROUND OF THE INVENTION

1. Field of the Invention

The present invention relates to a clamp having an arm for clamping a workpiece. The arm is rotatable at a predetermined angle by a drive mechanism.

2. Description of the Related Art

Clamp cylinders have conventionally been used in order to clamp a component of an automobile or the like to be welded. Such a clamp cylinder is disclosed in U.S. Pat. No. 4,458,889, for example.

As shown in FIGS. 16 and 17, in the clamp cylinder disclosed in the U.S. Pat. No. 4,458,889, a piston rod 2 is actuated by a cylinder 1*c* to reciprocate between a pair of divided bodies 1*a*, 1*b*. A coupling 3 is connected to an end of the piston rod 2. A pair of links 5*a*, 5*b* and a pair of rollers 6*a*, 6*b* are rotatably installed to both ends of the coupling 3 respectively by a first shaft 4. An arm 8 which is rotatable at a predetermined angle is connected between the pair of links 5*a*, 5*b* by a second shaft 7.

In this case, the pair of rollers 6*a*, 6*b* are slidable by a plurality of needles 9*a* which are installed to holes. The rollers 6*a*, 6*b* are slidable along track grooves 9*b* defined on the bodies 1*a*, 1*b*. The piston rod 2 is guided by the rollers 6*a*, 6*b* and displaceable together with the rollers 6*a*, 6*b*.

However, in the above conventional clamp cylinder disclosed in the U.S. Pat. No. 4,458,889, a surface of a workpiece (not shown) may be damaged when clamped by the arm 8 since the rotating arm strikes against the workpiece.

Specifically, when a door with its outer surface coated is clamped by the arm 8, an end (clamping portion) of the rotating arm 8 may strike by inertial force (rotational force) against the outer surface of the door, thereby causing damages on the coated surface.

SUMMARY OF THE INVENTION

It is a general object of the present invention to provide a clamp which makes it possible to reduce inertial force (rotational force) of an arm of the clamp when a workpiece is clamped thereby, for protecting the surface of the workpiece from an impact exerted by the arm.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
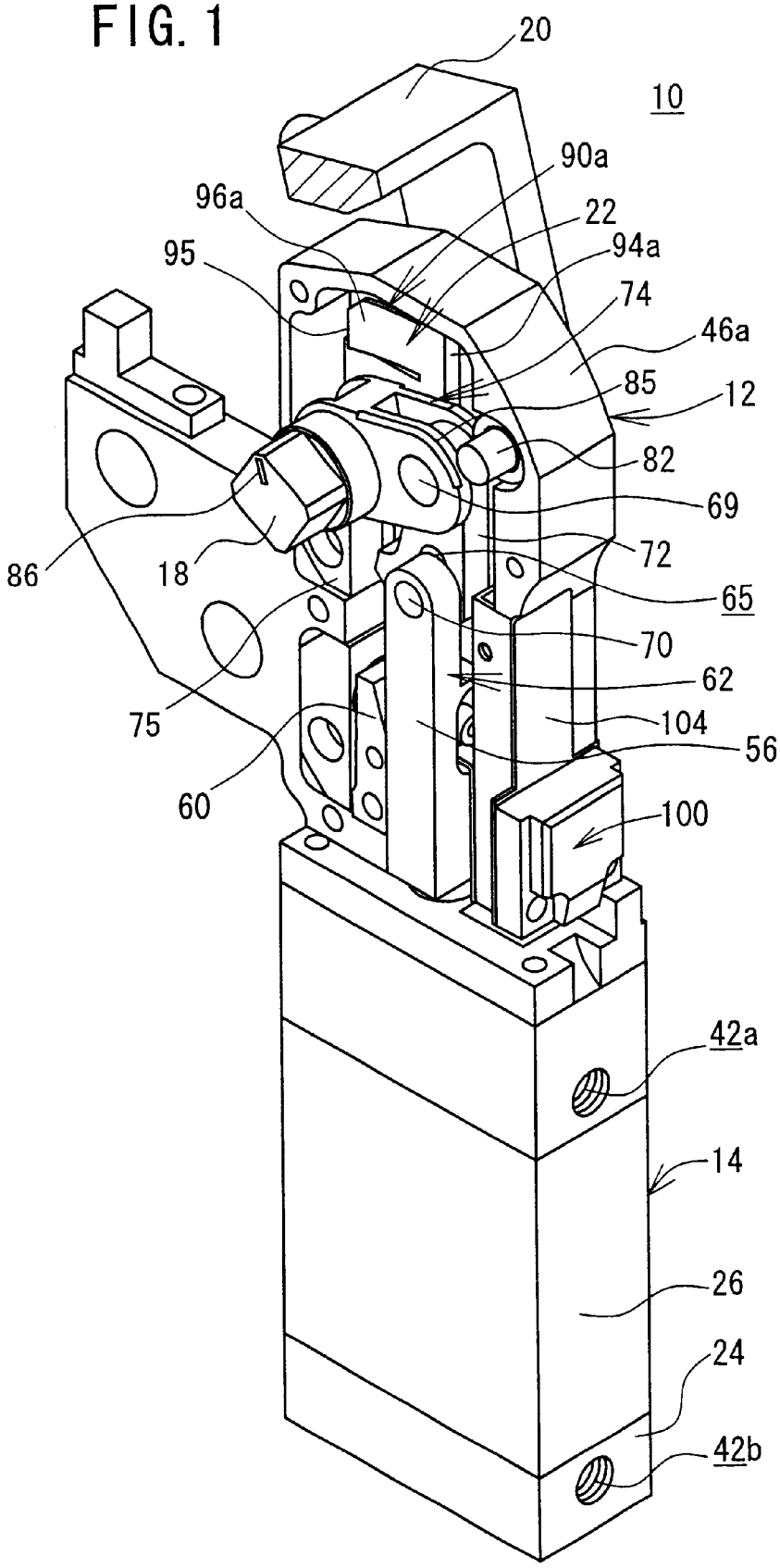
FIG. 1 is a partially-sectional exploded perspective view of a clamp according to an embodiment of the present invention.
Figure 2:
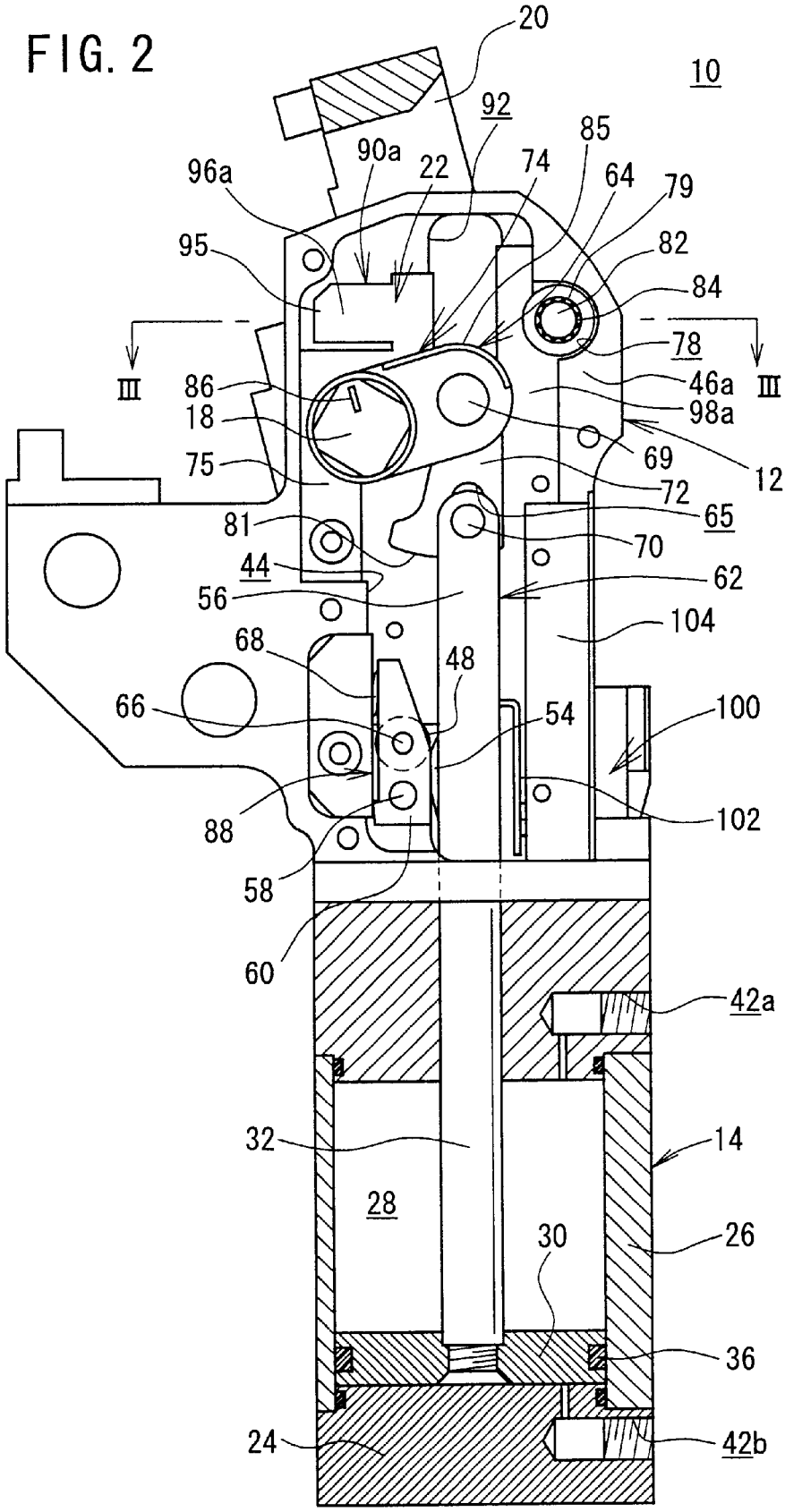
FIG. 2 is a partial vertical sectional view taken along an axis of the clamp according to the embodiment of the present invention.

In FIGS. 1 and 2, reference numeral 10 indicates a clamp according to an embodiment of the present invention.

The clamp 10 comprises a body 12, a cylinder section (drive mechanism) 14, an arm 20, and an impact-reducing mechanism 22. The cylinder section 14 is air-tightly connected to a lower end of the body 12. The arm 20 is connected to a coupling portion 18. The coupling portion 18 has a rectangular cross section and protrudes to the outside through a pair of substantially circular openings (not shown) formed in the body 12. The impact-reducing mechanism 22 is provided in the body 12 and reduces inertial force (rotational force) of the arm 20 rotating together with the coupling portion 18 as the center of rotation, thereby reducing an impact exerted when the arm 20 comes into contact with a workpiece (not shown).

The cylinder section 14 includes an end block 24 and a cylinder tube 26 in the shape of a rectangular pipe. The cylinder tube 26 has one end air-tightly connected to the end block 24 and the other end air-tightly connected to the body 12

As shown in FIG. 2, the cylinder section 14 also has a piston 30 and a rod 32. The piston 30 is housed in the cylinder tube 26 and reciprocates in a cylinder chamber 28. The rod 32 is connected to the center of the piston 30 and is displaceable together with the piston 30. The piston 30 has a substantially elliptic section on a plane orthogonal to the axis of the rod 32. A sectional shape of the cylinder chamber 28 is also substantially elliptic corresponding to that of the piston 30. A piston packing 36 is attached on an outer surface of the piston 30.

At the four corners of the end block 24, attachment holes (not shown) are defined. Four shafts (not shown) are inserted into the attachment holes for air-tightly assembling the end block 24, the cylinder tube 26, and the body 12. A pair of pressure fluid inlet/outlet ports 42*a,* 42*b* are defined in the body 12 and the end block 24, respectively, for introducing and discharging pressurized fluid (e.g., compressed air).

Figure 3:
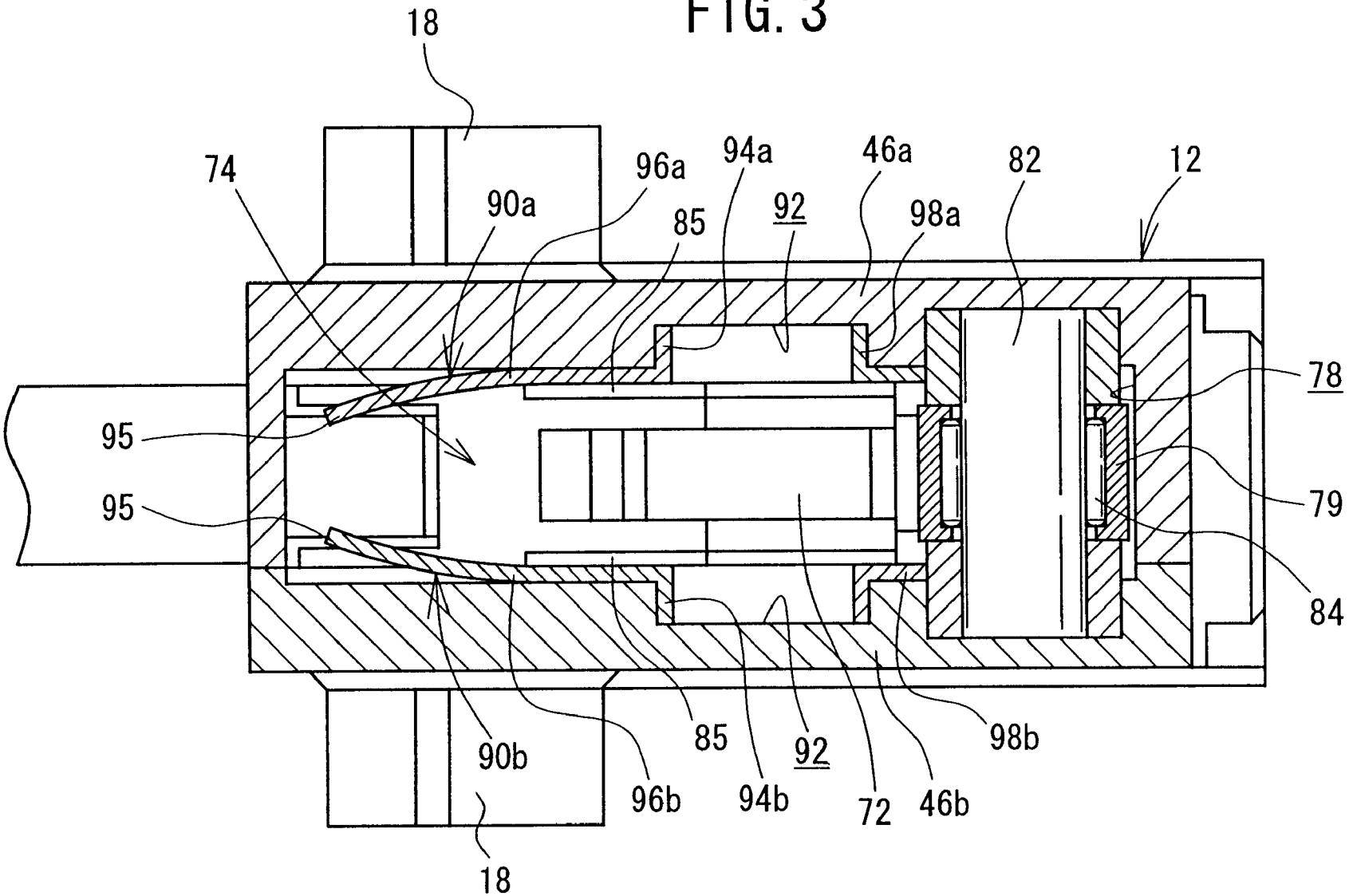
FIG. 3 is a cross sectional view taken along a line III-III shown in FIG. 2.
Figure 4:
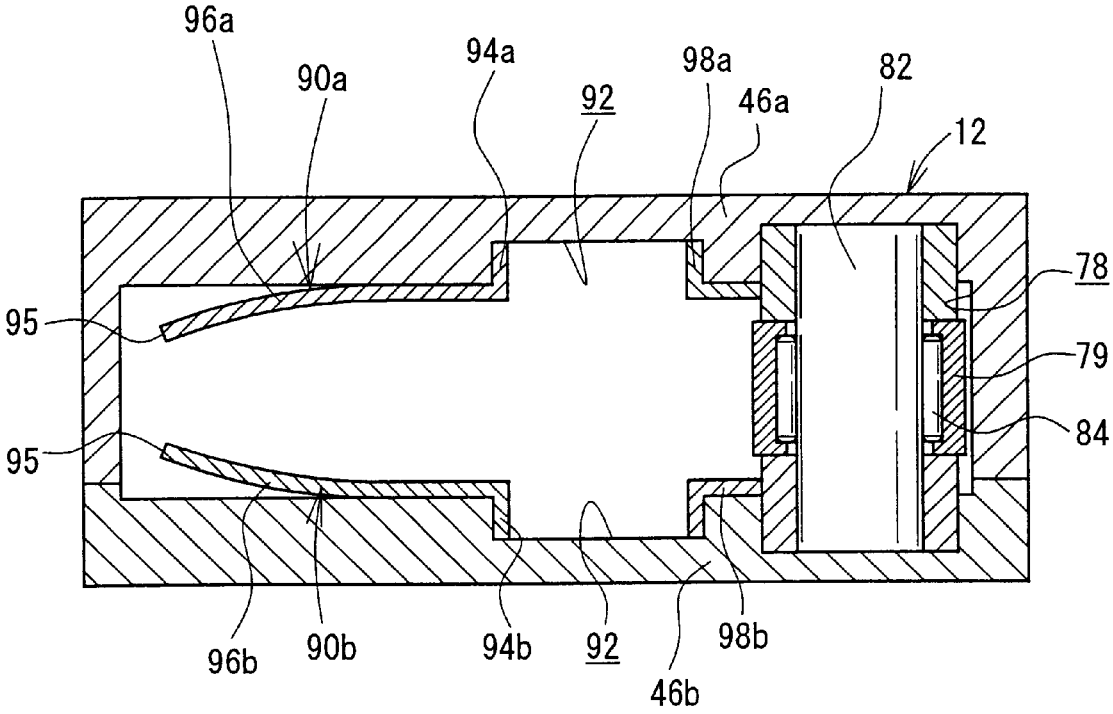
FIG. 4 is a cross sectional view in which an internal mechanism shown in FIG. 3 is omitted.

The body 12 integrally comprises a first casing 46*a* and a second casing 46*b* as shown in FIGS. 3 and 4. In the body 12, a chamber 44 is defined by the first casing 46*a* and the second casing 46*b* as shown in FIG. 2. A free end of the rod 32 is positioned in the chamber 44.

One end of the rod 32 is connected with a toggle link mechanism 64 through a knuckle joint 62. The toggle link mechanism 64 converts linear movement of the rod 32 into rotational movement of the arm 20 through the knuckle joint 62. The knuckle joint 62 comprises a knuckle block 56 and a knuckle pin 70. The knuckle block 56 has an end forked in parallel spacing at a predetermined distance, and the knuckle pin 70 is rotatably inserted into holes of the forked end. A portion 54 engaging with a roller 48 (described later) is formed on one side of the knuckle block 56 as shown in FIG. 3.

The toggle link mechanism 64 also has a link plate (link member) 72 and a support lever 74. The link plate 72 is connected with the knuckle joint 62 sandwiched in the forked end through the knuckle pin 70. The support lever 74 is rotatably supported in a pair of substantially circular openings defined by the first casing 46*a* and the second casing 46*b*. The support lever 74 may be integrally formed with the arm 20.

The link plate 72 is interposed and links between the knuckle joint 62 and the support lever 74.

That is, the link plate 72 has an oval hole 65 at one end and a hole (not shown) at the other end. The link plate 72 is connected to the free end of the rod 32 through the knuckle joint 62 and with the knuckle pin 70 in the oval hole 65. The link plate 72 is also connected to the forked end of the support lever 74 through a link pin 69 rotatably inserted in the hole. At the one end of the link plate 72, a curved surface 81 is formed for being in contact with a guide roller 79 (described later) as shown in FIG. 2.

In such a structure, since the oval hole 65 of the link plate 72 gives a play to the knuckle pin 70, the link plate 72 can be freely displaced within the oval hole 65. Stated otherwise, the curved surface 81 of the link plate 72 is remained to be contact with the guide roller 79 in spite of a rotation angle of the arm 20.

The support lever 74 has a forked end and the coupling portion 18. The link pin 69 is rotatably inserted into a hole defined in the forked end. The coupling portion 18 protrudes in a direction orthogonal to the axis of the rod 32 (direction normal to the sheet of FIG. 2) and is exposed to the outside through an opening (not shown) of the body 12. Partial circumferences of the forked end are chamfered as chamfered portions 85 for engaging with a plate spring (described later).

The arm 20 is detachably attached to the coupling portion 18 for clamping the workpiece (not shown). A mark 86 is provided on a side of the coupling portion 18 for indicating a rotation angle of the arm 20. The support lever 74 is rotated together with the arm 20.

A lever stopper 75 is fixed by a screw to an internal corner of the first casing 46*a* under the coupling portion 18 for limiting the rotational movement of the support lever 74.

The lever stopper 75 may be formed by bulging the first casing 46*a* or the second casing 46*b* without being provided separately.

As shown in FIGS. 1 and 2, a lock mechanism 88 in the chamber 44 includes a support pin 58, a lock plate 60, a roller 48, the engaging portion 54, and a spring 68. The support pin 58 is supported by the first casing 46*a* and the second casing 46*b*. One end of the lock plate 60 is supported rotatably about the support pin 58 at a predetermined angle. The roller 48 is supported rotatably about a pin 66 in a forked end of the lock plate 60. The engaging portion 54 is provided on the knuckle block 56 and has a first slanted surface, a second slanted surface, and a middle surface between the first and second slanted surfaces. One end of the spring 68 is fastened to a recess (not shown) at the other end of the lock plate 60, which is opposite to the one end having the support pin 58.

The other end of the spring 68 is fastened to a recess (not shown) defined in an inner surface of the first casing 46*a*. The spring constantly presses the lock plate 60 toward the knuckle block 56 by elastic force thereof about the support pin 58. In other words, the lock plate 60 is rotatable about the support pin 58 at a predetermined angle when some pressing force stronger than the elastic force of the spring 68 is exerted on the roller 48.

Figure 5:
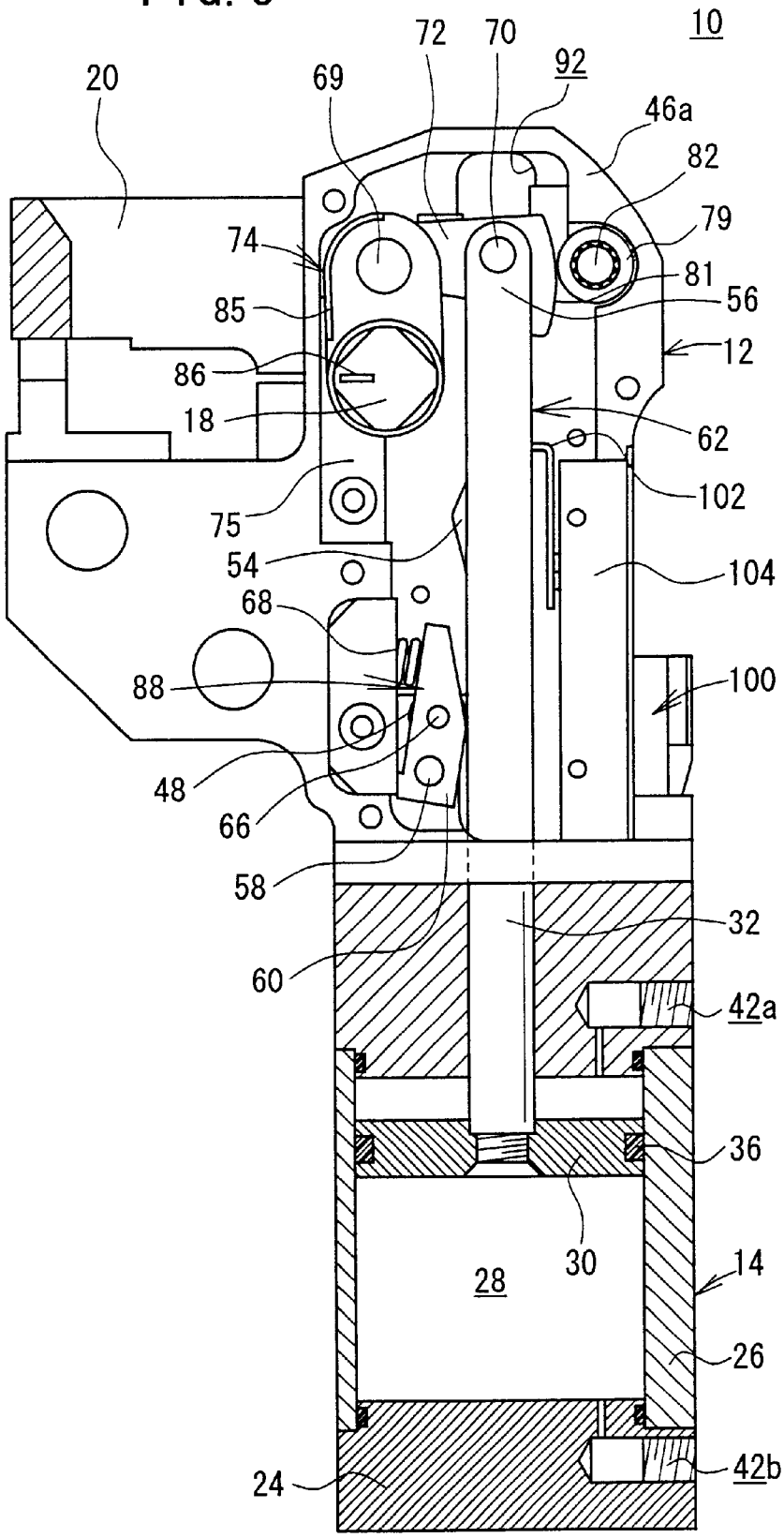
FIG. 5 is a partial vertical sectional view of illustrating that a workpiece is clamped.

On an upper part of an inner surface of each of the first casing 46*a* and the second casing 46*b* of the body 12, a recess 78 having a circular section is formed. A guide roller 79 is provided on the recess 78 for rotating at a predetermined angle while being contact with the curbed surface 81 of the link plate 72 as shown in FIG. 5. A pin 82 is inserted in holes defined in the first casing 46*a* and the second casing 46*b* for rotatably supporting the guide roller 79. A plurality of needle bearings 84 are inserted in a through hole of the guide roller 79 along a circumference of the through hole, thereby smoothly rotating the guide roller 79 by rolling action of the needle bearings 84.

Further, on the upper part of the inner surface of each of the first casing 46*a* and the second casing 46*b* of the body 12, the impact-reducing mechanism 22 is located for reducing an impact exerted when the arm 20 rotates together with the coupling portion 18 and clamps the workpiece.

Figure 6:
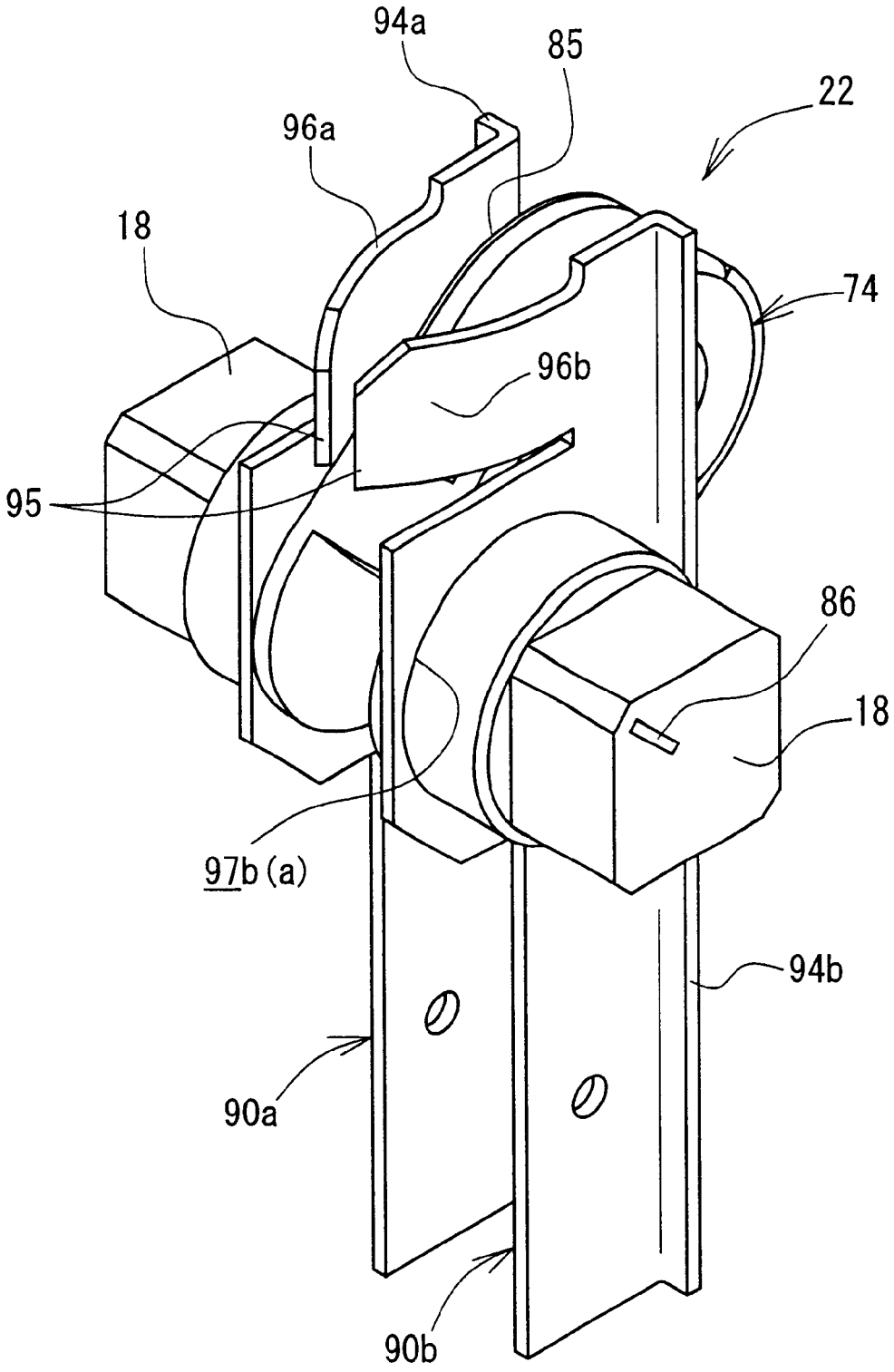
FIG. 6 is a perspective view illustrating an operation of an impact-reducing mechanism.
Figure 7:
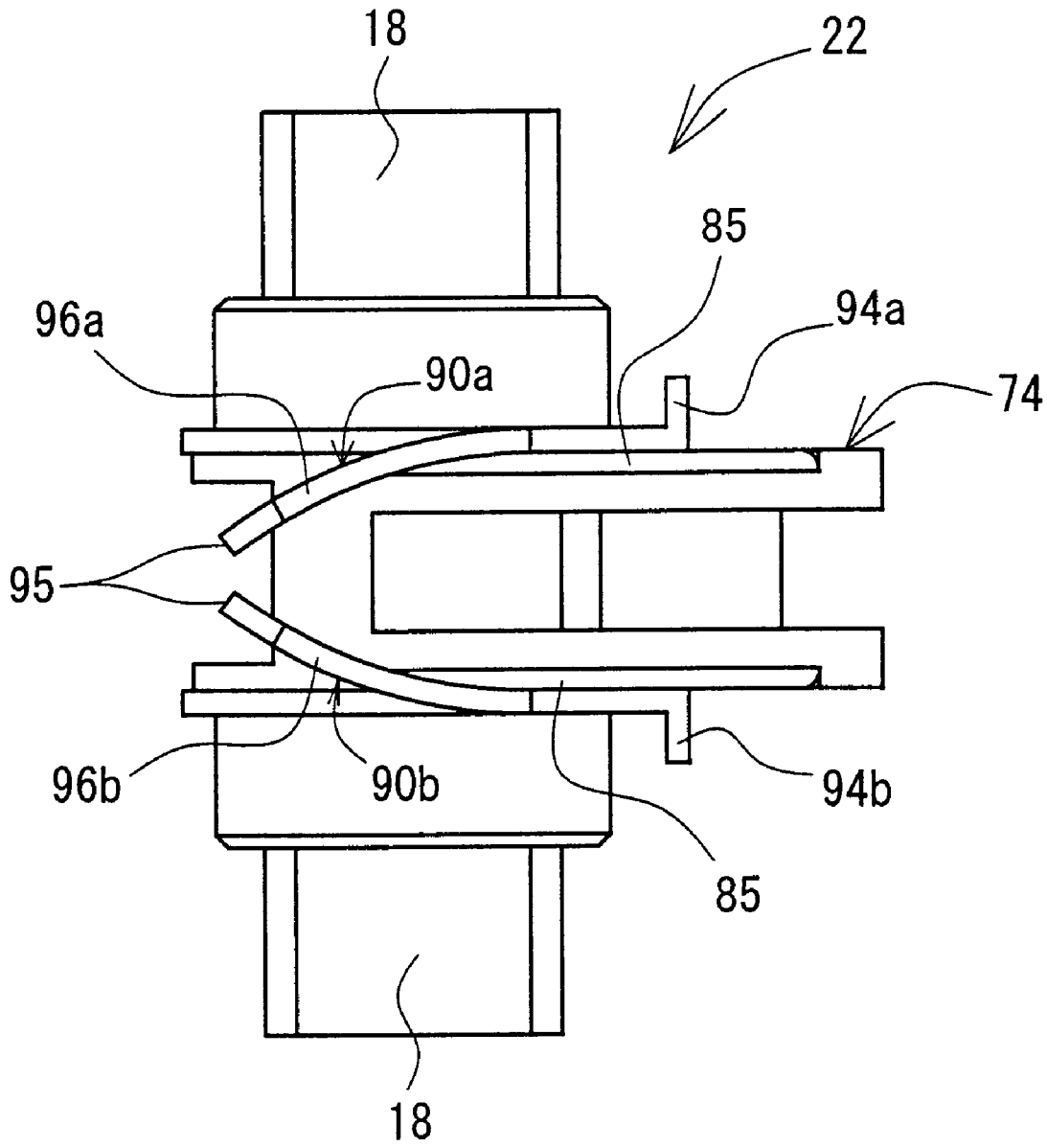
FIG. 7 is a plan view of the impact-reducing mechanism shown in FIG. 6.
Figure 8:
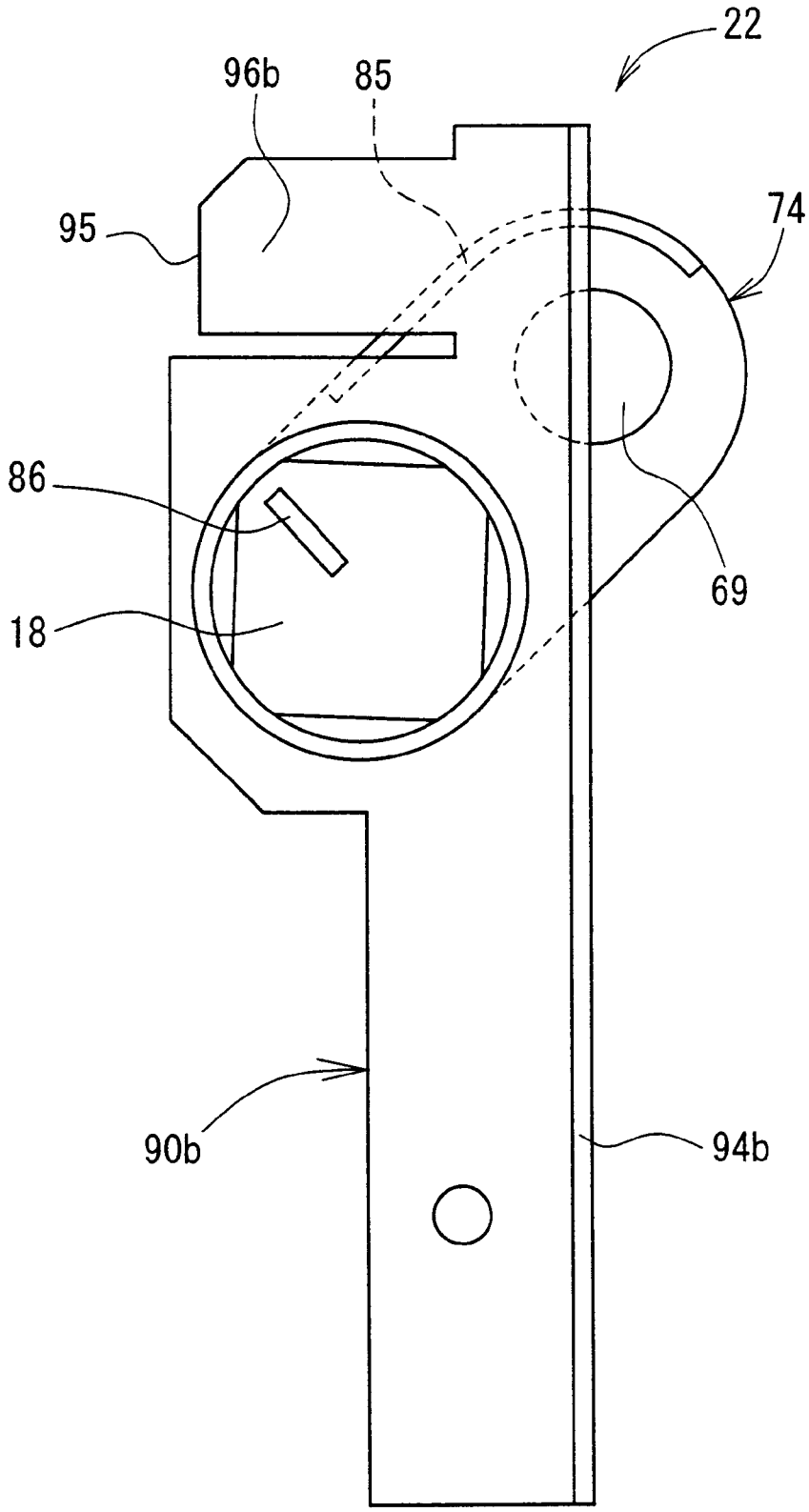
FIG. 8 is a side view of the impact-reducing mechanism shown in FIG. 6.

As shown in FIGS. 6 through 8, the impact-reducing mechanism 22 includes a first plate 90*a* fixed to the inner surface of the first casing 46*a* by a screw (not shown) and a second plate 90*b* fixed to the inner surface of the second casing 46*b* by a screw (not shown). The first plate 90*a* and the second plate 90*b* face to each other.

The first plate 90*a* and the second plate 90*b* are formed symmetrically to each other and have first and second guides 94*a,* 94*b,* first and second plate springs 96*a,* 96*b,* and substantially circular first and second guide holes 97*a,* 97*b,* respectively. The first and second guides 94*a,* 94*b* are formed along guide grooves 92 (see FIGS. 2 through 4) of the first casing 46*a* and the second casing 46*b*. The first and second plate springs 96*a,* 96*b* are curved such that their respective ends 95 approach each other.

The first and second plate springs 96*a,* 96*b* are positioned on an upper part of the first and second plates 90*a,* 90*b,* respectively, and protrude horizontally in a predetermined length toward the assumed workpiece to be clamped by the arm 20. The ends 95 can approach and separate from each other while the first and second plate springs 96*a,* 96*b* are supported by the first and second guides 94*a,* 94*b* attached to the guide grooves 92.

The sides of the support lever 74 between the curving first and second plate springs 96*a,* 96*b* are pressed by the ends 95 thereof with elastic force when the arm 20 and the support lever 74 integrally rotates for clamping the workpiece (see FIG. 9 through 14). Accordingly, the rotational force of the arm 20 rotating together with the support lever 74 is reduced by the pressure applied on the support lever 74 by the ends 95 of the first and second plate springs 96*a,* 96*b,* thereby reducing the impact exerted when the arm 20 comes in contact with the workpiece. The outer surface of the workpiece is prevented from being damaged by the arm 20 when the workpiece is clamped by the rotating arm 20. As a result, the outer surface of the workpiece can be protected from the impact.

Figure 15:
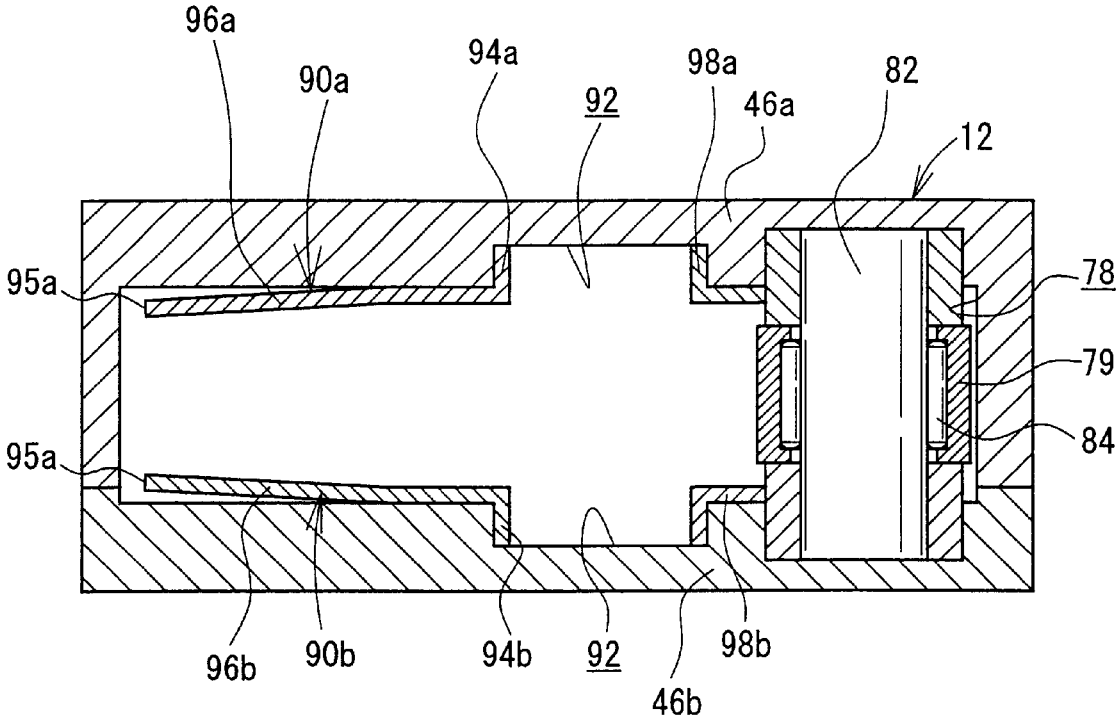
FIG. 15 is a cross sectional view illustrating a modified example of plate springs.
Figure 16:
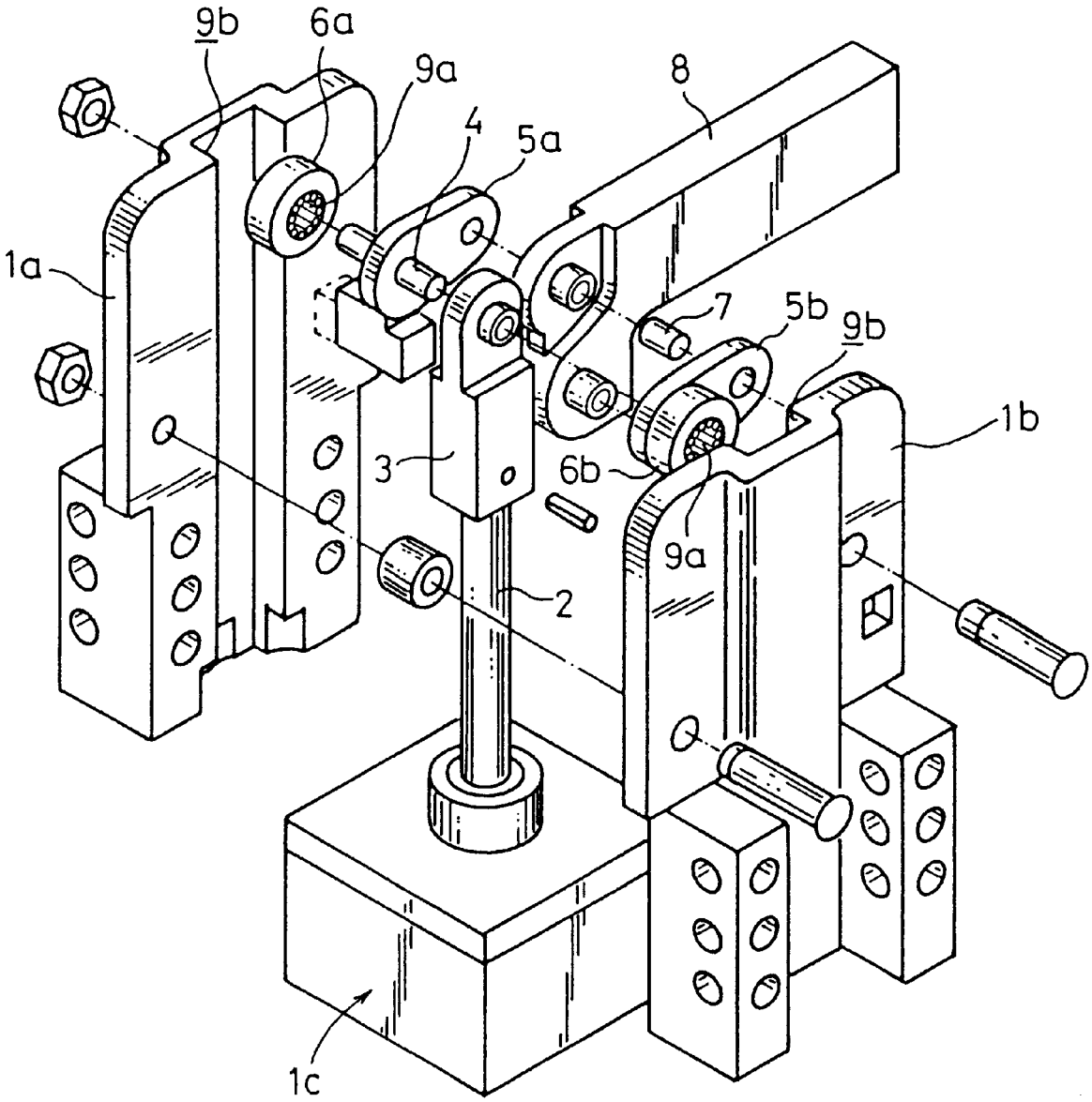
FIG. 16 is an exploded perspective view illustrating major parts of a conventional clamp cylinder.
Figure 17:
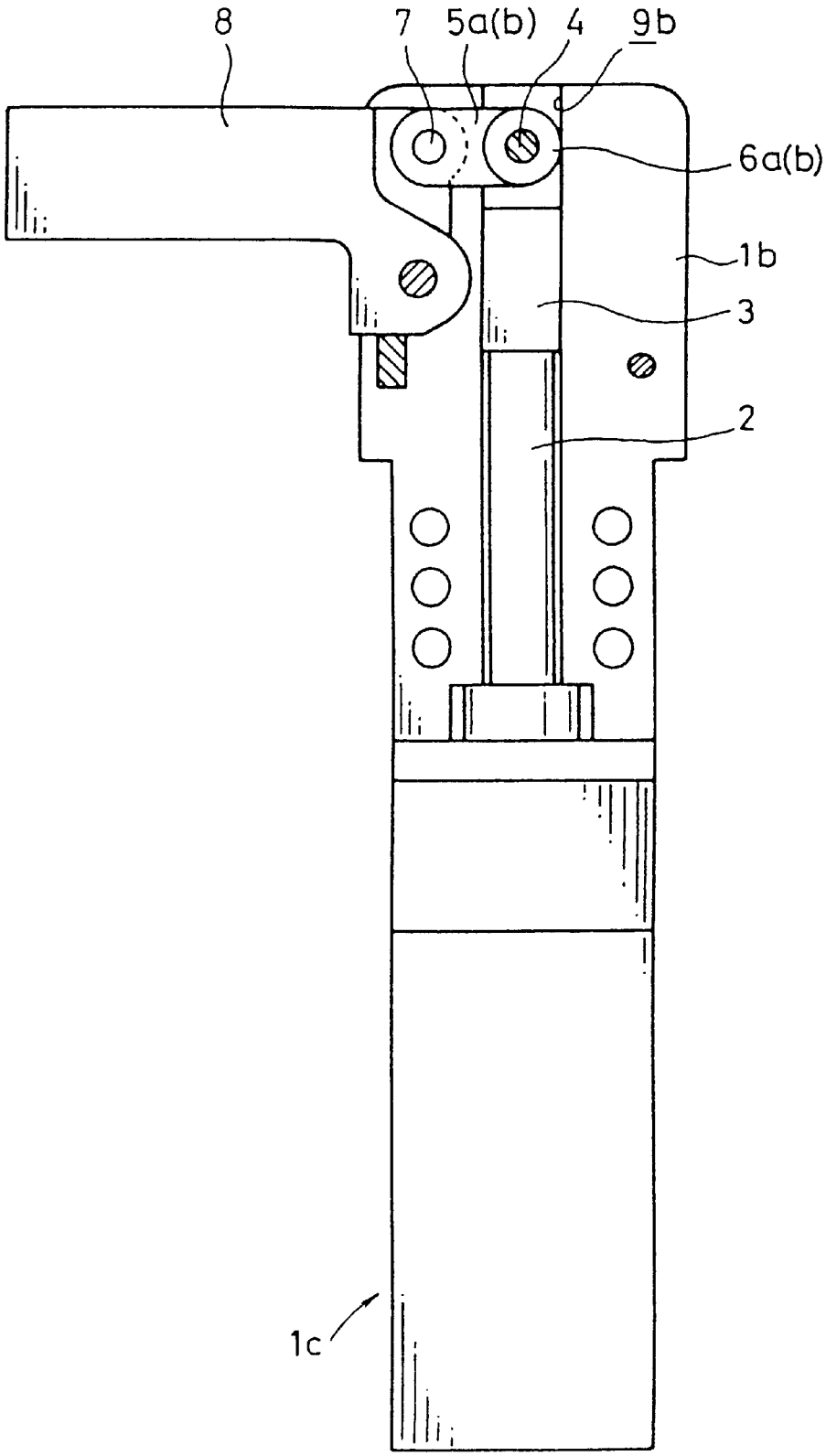
FIG. 17 is, with partial vertical section, a side view of the clamp cylinder shown in FIG. 16.

As shown in FIG. 15, the first and second plate springs 96*a,* 96*b* may extend substantially straight to ends 95*a* without curving. In this structure, the first and second plate springs 96*a,* 96*b* may not be curved to approach each other.

As shown in FIGS. 3 and 4, a pair of guide members 98*a,* 98*b* are attached to the guide grooves 92 of the first casing 46*a* and the second casing 46*b*. The guide members 98*a,* 98*b* have an L-shaped cross section and extend along the axis of the guide groove 92 in a predetermined length to face to each other.

As shown in FIGS. 1 and 2, a position detection mechanism 100 is installed to the first casing 46*a* and the second casing 46*b* for detecting displacement of the rod 32, and is exposed to the outside. The position detection mechanism 100 includes an element to be detected (not shown) displaced together with the rod 32 by means of a fixture 102 and a pair of detecting elements (not shown) attached to a casing 104 spacing at a predetermined distance.

The clamp 10 according to the embodiment of the present invention is basically structured as described above. Next, its operation, function, and effect will be explained.

The clamp 10 is fixed to a predetermined position with some fixing means (not shown). The pair of pressure fluid inlet/outlet ports 42*a,* 42*b* are connected with ends of tubes (not shown), respectively, while the other ends of tubes are connected to a pressurized fluid source (not shown)

After that, the pressurized fluid source is actuated to introduce pressurized fluid such as compressed air from the pressure fluid inlet/outlet port 42*b* to the cylinder chamber 28 on the lower side of the piston 30. The piston 30 is pressed by the pressurized fluid introduced into the cylinder chamber 28 and moves upward along the cylinder chamber 28.

The linear movement of the piston 30 is transferred to the toggle link mechanism 64 through the rod 32 and the knuckle joint 62 moving upward along the guide groove 92, and is converted into rotational movement of the arm 20 by the rotational movement of the support lever 74 of the toggle link mechanism 64.

That is, when the piston 30 moves linearly (upward), the knuckle joint 62 and the link plate 72 connected to the free end of the rod 32 are pressed upward. The pressing force to the link plate 72 makes the link plate 72 rotate at a predetermined angle about the knuckle pin 70 and also makes the support lever 74 rotate by a linking action of the link plate 72.

Accordingly, the arm 20 is rotated counterclockwise together with the coupling portion 18 of the support lever 74.

During the counterclockwise rotation of the arm 20, the guide roller 79 rotates about the pin 82 while the guide roller 79 is kept in contact with the curved surface 81.

When the arm 20 is further rotated and comes in contact with a workpiece (not shown), the arm 20 stops rotating. Accordingly, the workpiece is clamped by the arm 20 (see FIG. 5).

The operation of the impact-reducing mechanism 22 for reducing an impact exerted when the arm 20 clamps the workpiece (not shown) will be described hereinafter.

Figure 9:
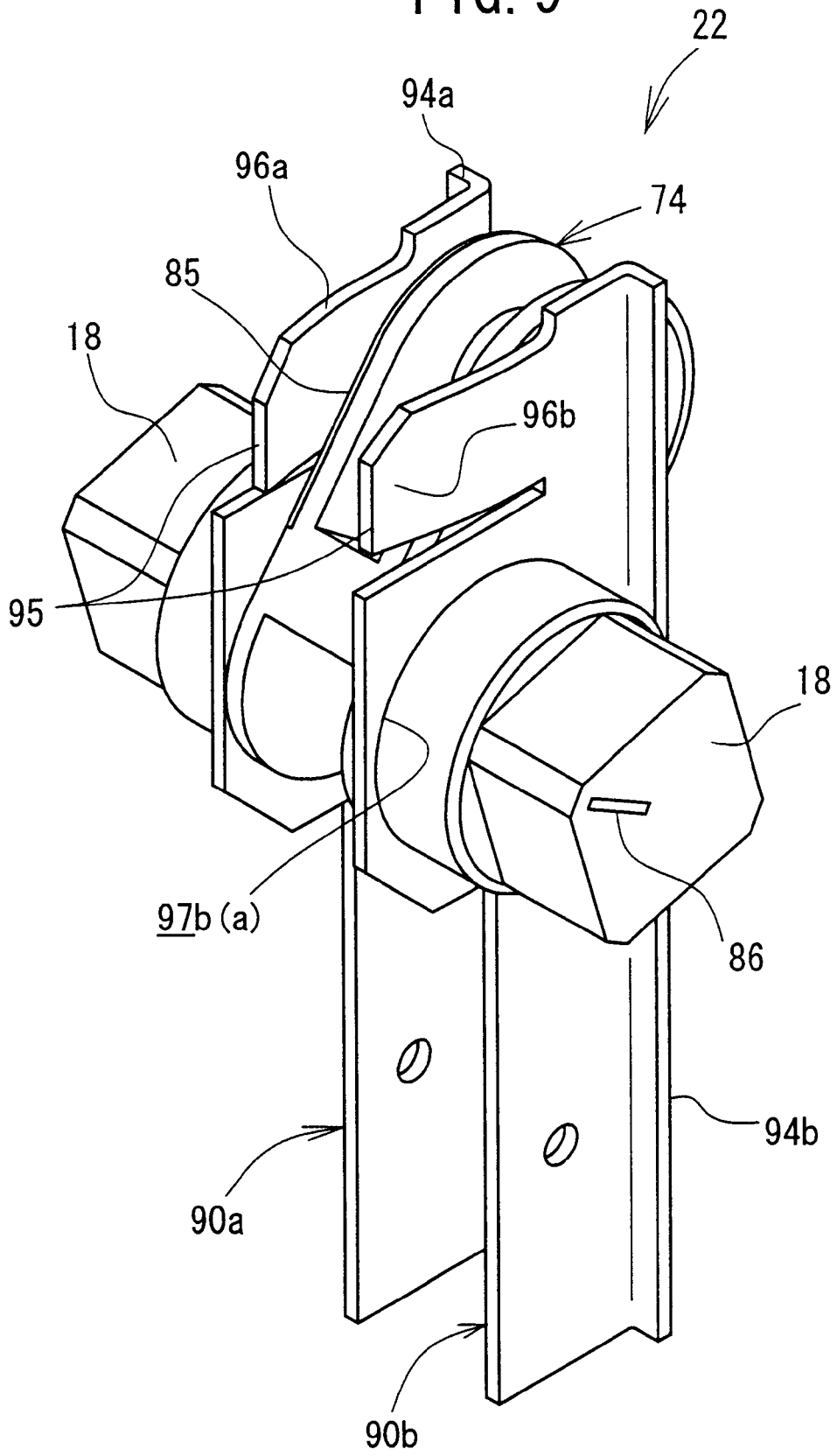
FIG. 9 is a perspective view of the impact-reducing mechanism illustrating that a support lever is slightly rotated counterclockwise together with a coupling portion.
Figure 10:
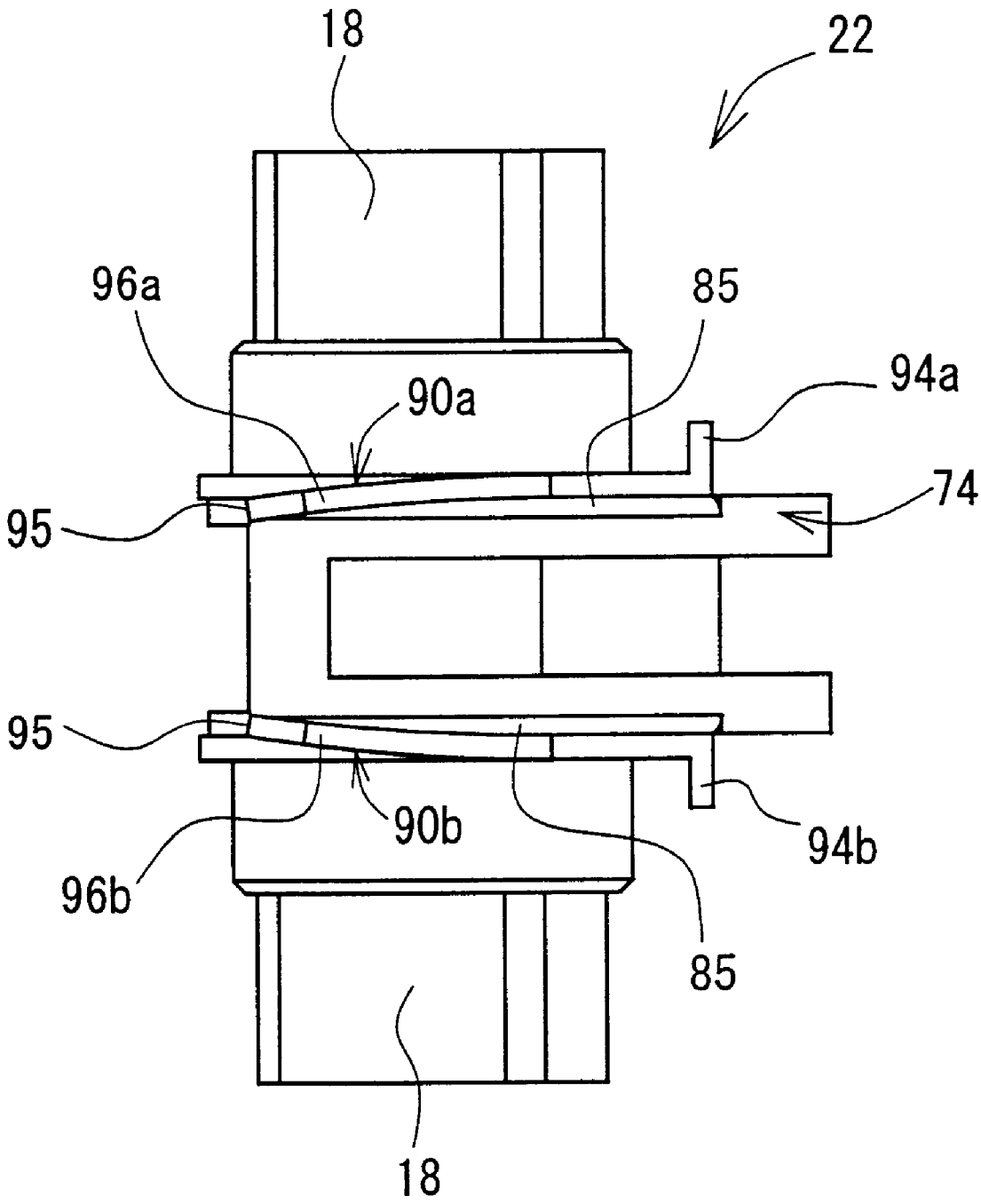
FIG. 10 is a plan view of the impact-reducing mechanism shown in FIG. 9.
Figure 11:
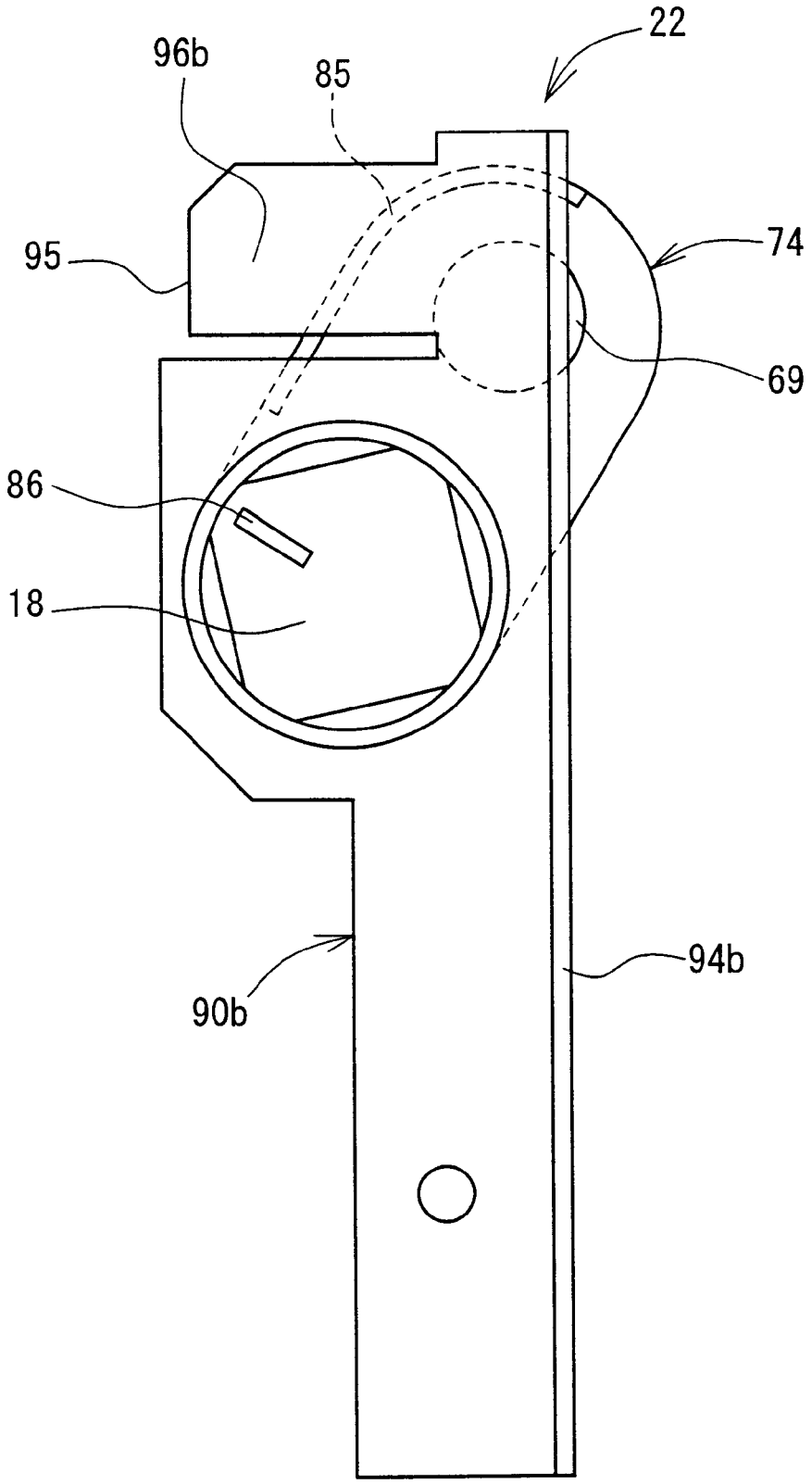
FIG. 11 is a side view of the impact-reducing mechanism shown in FIG. 9.
Figure 12:
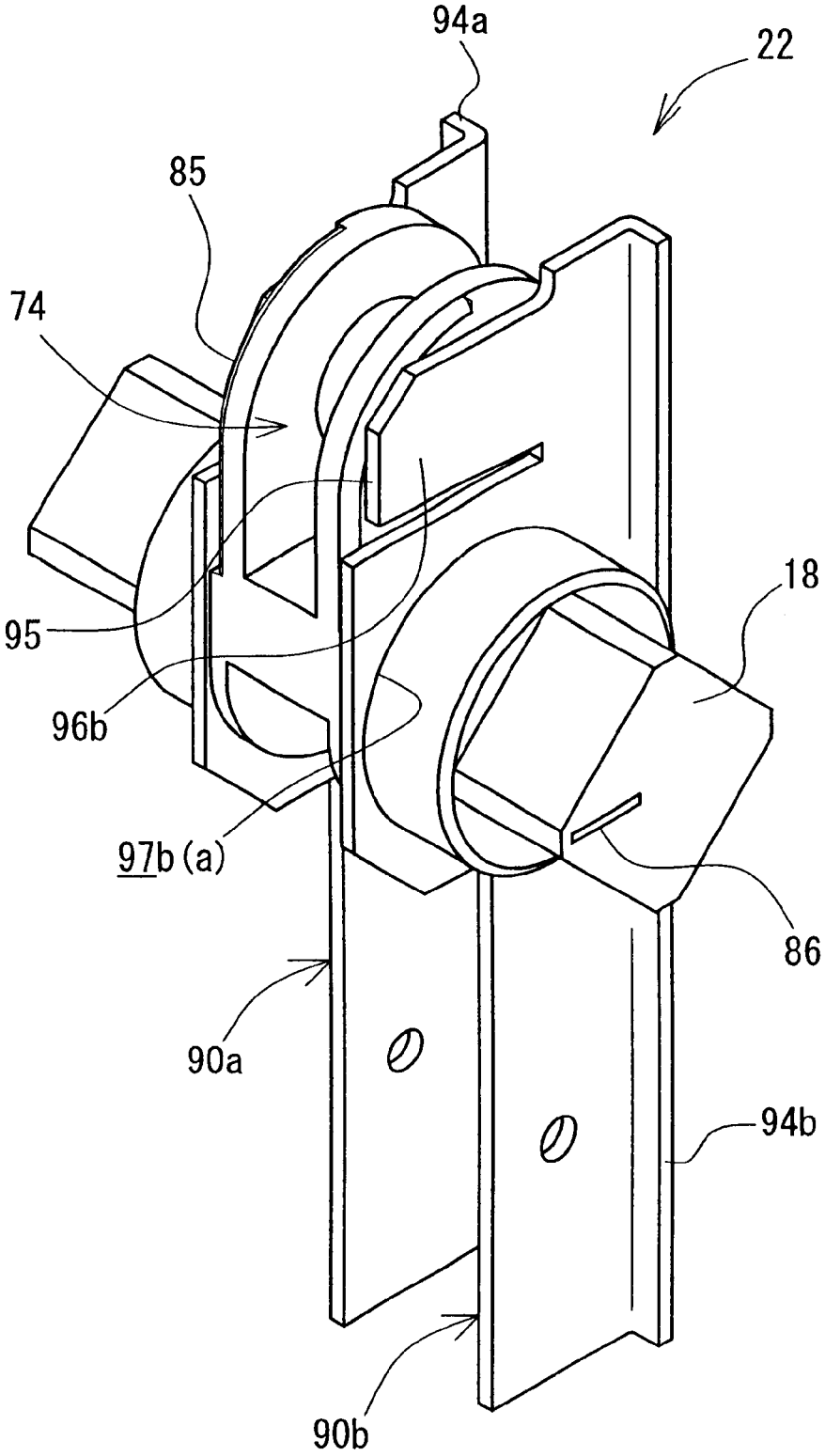
FIG. 12 is a perspective view of the impact-reducing mechanism illustrating that the support lever is further rotated counterclockwise from a position shown in FIG. 9 and the workpiece is clamed.
Figure 13:
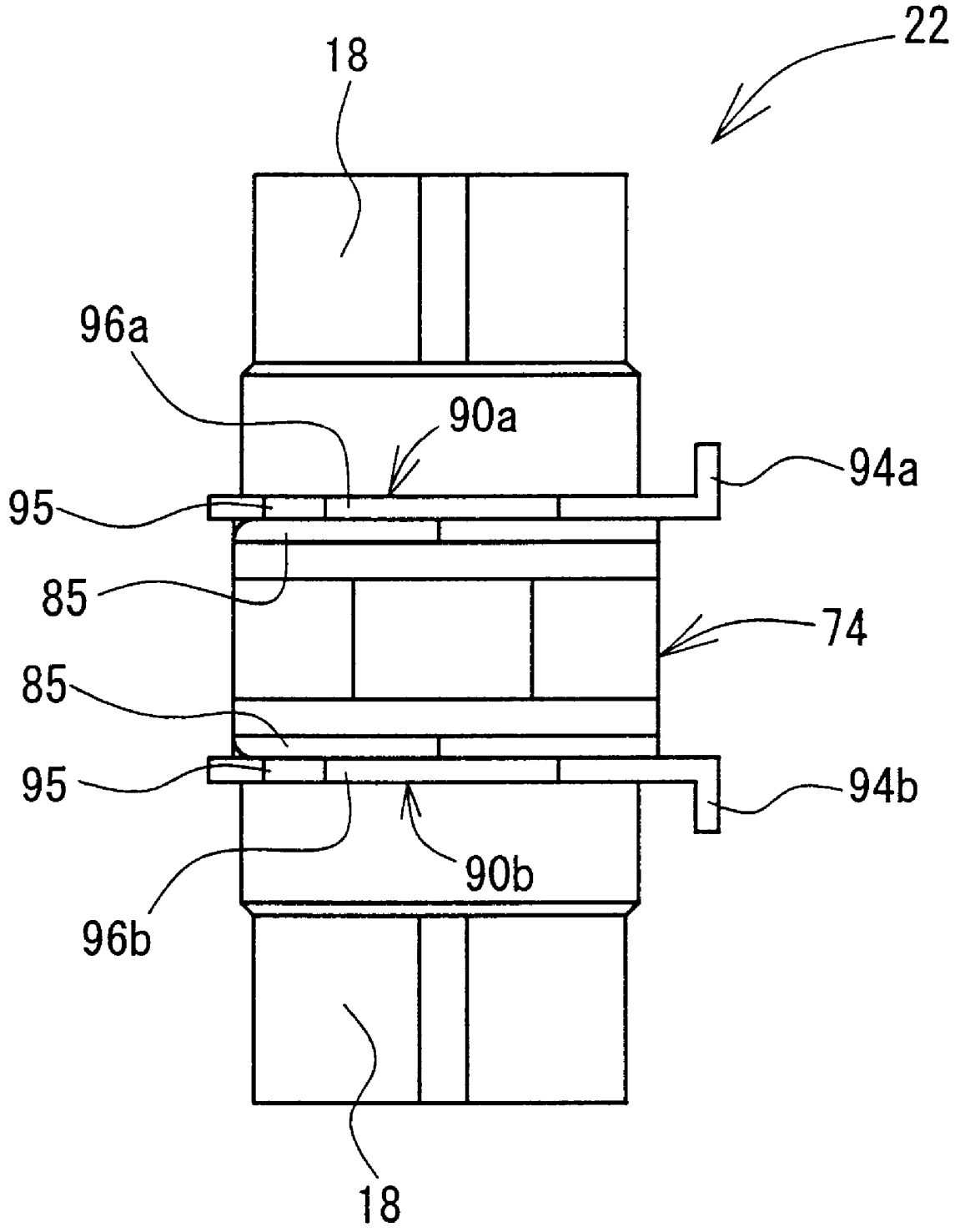
FIG. 13 is a plan view of the impact-reducing mechanism shown in FIG. 12.
Figure 14:
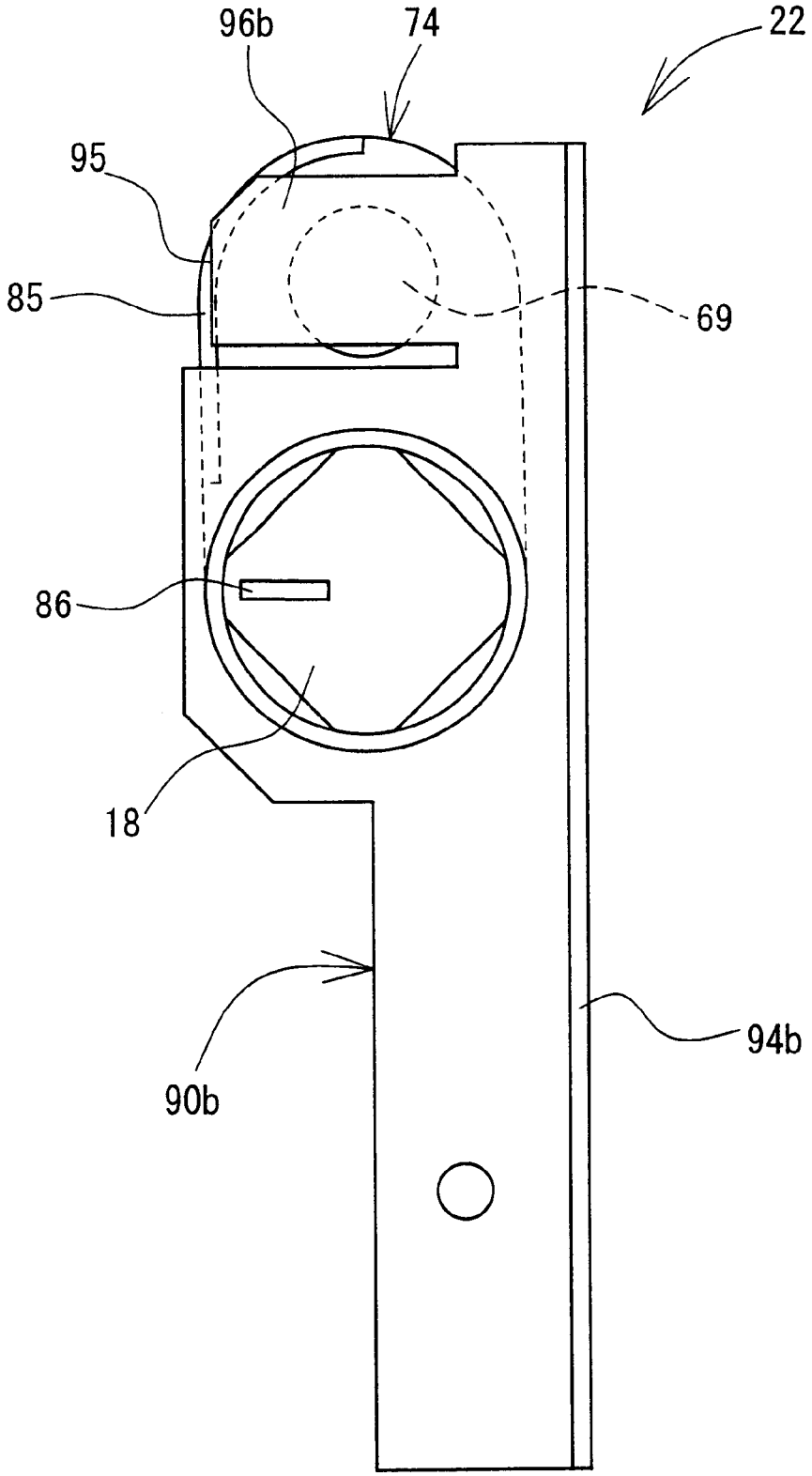
FIG. 14 is a side view of the impact-reducing mechanism shown in FIG. 12.

As shown in FIGS. 1 and 2, when the support lever 74 is rotated by the linking action of the link plate 72 and the arm 20 is rotated counterclockwise together with the coupling portion 18 of the support lever 74 at a predetermined angle, the sides of the support lever 74 between the pair of first and second plate springs 96*a,* 96*b* engaged with the ends 95 (see FIGS. 9 through 11). As the support lever 74 is rotated counterclockwise along with the arm 20, a spacing distance between the ends 95 of the first and second plate springs 96*a,* 96*b* gradually increases. In the same period of time, the pressing force exerted on the support lever 74 gradually increases by the elastic force of the first and second plate springs 96*a,* 96*b* (see FIGS. 12 through 14).

The pressing force by the ends 5 of the pair of first and second plate springs 96*a,* 96*b* limits the rotational movement of the arm 20. Thus, the speed of the arm 20 just before a workpiece is reduced, so that an impact when the arm 20 comes into contact with the workpiece is reduced. As a result, the outer surface of the workpiece clamped by the arm 20 is prevented from being damaged, and a coating layer on the outer surface of the workpiece can be protected.

For releasing the workpiece and separating the arm 20 from the workpiece, in the opposite way to the above, the pressurized fluid is introduced from the pressure fluid inlet/outlet port 42*a* to the cylinder chamber 28 on the upper part of the piston 30 by switching a directional control valve (not shown). The piston 30 is pressed by the pressurized fluid introduced into the cylinder chamber 28 and moves downward along the cylinder chamber 28.

The linear movement of the piston 30 is converted into the rotational movement of the arm 20 by the toggle link mechanism 64, and the arm 20 is rotated clockwise.

The support lever 74 is rotated clockwise together with the arm 20 until a side of the support lever 74 is in contact with the lever stopper 75. The clockwise rotation of the support lever 74 is limited thereby, and the lock mechanism 88 holds the arm 20 in the state when the piston 30 reaches the lowest position in the cylinder chamber.

Though the cylinder section 14 is used as a drive mechanism in the present embodiment, the present invention is not limited to the mechanism and the rod 32 may be displaced by a linear actuator, an electric motor, or the like (not shown).

While the invention has been particularly shown and described with reference to preferred embodiments, it will be understood that variations and modifications can be effected thereto by those skilled in the art without departing from the spirit and scope of the invention as defined by the appended claims.

What is claimed is:

1. A clamp comprising:

a body;

a drive mechanism for displacing a rod in said body along an axis of said body;

a toggle link mechanism including a link member connected with said rod and a support lever linked with said link member for converting linear movement of said rod into rotational movement;

an arm connected with said toggle link mechanism and rotating at a predetermined angle by said drive mechanism; and an impact-reducing mechanism provided in said body and reducing rotational force of said arm when said arm driven by said drive mechanism is rotated and clamps a workpiece, thereby reducing an impact exerted when said arm comes into contact with the workpiece, wherein said impact-reducing mechanism comprises a first plate and a second plate, said support lever being positioned between said first plate and said second plate, and said first plate and said second plate respectively comprise plate springs for engaging with sides of said support lever.

2. The clamp according to claim 1, wherein said first plate and said second plate have guides, respectively, and said guides are formed along guide grooves extending along the axis of said body.

3. The clamp according to claim 1, wherein said first plate is fixed to an inner surface of a first casing of said body and said second plate is fixed to an inner surface of a second casing of said body.

4. The clamp according to claim 1, wherein said plate springs protrude horizontally toward the workpiece and have ends which can approach and separate from each other, while said plate springs are supported by said guides on said guide grooves.

5. The clamp according to claim 1, wherein said plate springs have respective ends, and sides of said support lever between said plate springs are pressed by said ends with elastic force when said arm clamps the workpiece.

6. The clamp according to claim 5, wherein a chamfered portion is formed on a circumference of said support lever for engaging with said ends of said plate springs.

7. The clamp according to claim 1, wherein said drive mechanism comprises a cylinder section including a piston pressed and displaced by pressurized fluid introduced from a pair of pressure fluid inlet/outlet ports to a cylinder chamber.

8. The clamp according to claim 1, wherein said plate springs are integral with said first and second plates respectively.

9. A clamp comprising:

a body;

a drive mechanism for displacing a rod in said body along an axis of said body;

a toggle link mechanism including a link member connected with said rod and a support lever linked with said link member for converting linear movement of said rod into rotational movement;

an arm connected with said toggle link mechanism and rotating at a predetermined angle by said drive mechanism; and an impact-reducing means, provided in said body, for reducing rotational force of said arm when said arm driven by said drive mechanism is rotated and clamps a workpiece, thereby reducing an impact exerted when said arm comes into contact with the workpiece.

10. The clamp according to claim 9, wherein said impact-reducing means comprises a first plate and a second plate, said support lever being positioned between said first plate and said second plate, and said first plate and said second plate respectively comprise plate springs for engaging with sides of said support lever.

11. The clamp according to claim 10, wherein said plate springs are integral with said first and second plates respectively.

12. The clamp according to claim 10, wherein said first plate and said second plate have guides, respectively, and said guides are formed along guide grooves extending along the axis of said body.

13. The clamp according to claim 10, wherein said first plate is fixed to an inner surface of a first casing of said body and said second plate is fixed to an inner surface of a second casing of said body.

14. The clamp according to claim 10, wherein said plate springs protrude horizontally toward the workpiece and have ends which can approach and separate from each other, while said plate springs are supported by said guides on said guide grooves.

15. The clamp according to claim 10, wherein said plate springs have respective ends, and sides of said support lever between said plate springs are pressed by said ends with elastic force when said arm clamps the workpiece.

16. The clamp according to claim 15, wherein a chamfered portion is formed on a circumference of said support lever for engaging with said ends of said plate springs.

17. The clamp according to claim 11, wherein said drive mechanism comprises a cylinder section including a piston pressed and displaced by pressurized fluid introduced from a pair of pressure fluid inlet/outlet ports to a cylinder chamber.

* * * * *